United States Patent [19]

Good

[11] 4,094,113

[45] June 13, 1978

[54] MODULAR WALL PANEL STRUCTURE

[75] Inventor: Wayne W. Good, Sturgis, Mich.

[73] Assignee: Harter Corporation, Sturgis, Mich.

[21] Appl. No.: 728,433

[22] Filed: Sep. 30, 1976

[51] Int. Cl.[2] ..... E04B 2/74

[52] U.S. Cl. ..... 52/222; 52/238; 52/586

[58] Field of Search ..... 52/586, 238, 239, 240, 52/241, 242, 243, 281, 63

[56] References Cited

U.S. PATENT DOCUMENTS

| | | | |
|---|---|---|---|
| 2,999,568 | 9/1961 | Ludwig | 52/497 |
| 3,075,253 | 1/1963 | Hammitt | 52/586 |
| 3,700,385 | 10/1972 | Sherwood | 52/239 |
| 3,998,015 | 12/1976 | Scott | 52/222 |

FOREIGN PATENT DOCUMENTS

| | | | |
|---|---|---|---|
| 961,234 | 1/1975 | Canada | 52/239 |
| 2,355,156 | 5/1975 | Germany | 52/122 |

*Primary Examiner*—John E. Murtagh

*Attorney, Agent, or Firm*—Hamilton, Renner & Kenner

[57] ABSTRACT

A wall panel module or unit insertable in edge abutment with like modules in an outer rectangular frame forming a free-standing partition wall and the like. The panel has a rectangular frame with outwardly open side channels for containing vertical splines which are movably mounted in the top and bottom of the outer frame. The splines are positioned between the side of one panel and the abutting outer frame member and between the sides of abutting panels. The splines are accessible at the butt joints for moving the splines laterally of the panels to allow removal and replacement thereof, and positioning means in the channels releasably holds the splines medially of the butt joints.

11 Claims, 5 Drawing Figures

MODULAR WALL PANEL STRUCTURE

BACKGROUND OF THE INVENTION

This invention is in the field of movable wall panels and space dividers which may be made to conform and fit a desired functional usage. There are in the prior art many types of wall panels of designs useful in designing and arranging floor plans for buildings to meet various functional needs of offices, homes or the like.

Typical of such prior art is that shown in the following patent references:

| U.S. Pat. Nos. | | |
|---|---|---|
| 1,154,622 | 2,730,209 | 2,787,812 |
| 2,832,101 | 3,694,975 | 3,713,257 |
| 3,049,197 | 3,492,766 | 3,429,601 |
| 3,488,908 | 3,852,926 | 2,107,624 |
| 3,299,594 | 3,075,253 | 2,371,300 |
| 3,194,361 | 3,377,756 | 3,643,395 |
| | 3,919,820 | |
| **Great Britain Pat. Nos.** | | |
| 179,840 (1922) | 197,184 (1923) | |
| **Italy Pat. No.** | | |
| 553,280 (1956) | | |
| **Sweden Pat. No.** | | |
| 129,429 (1950) | | |

These movable walls and dividers are of such construction, however, that they are not adaptable to quick assembly or to new and changing material and design concepts for decorating or redecorating. In addition, the prior known wall panels are burdensome to assemble and, in some instances, do not provide sufficient separation of office functions to prevent noise or other distracting influences from the next adjacent area, and do not have the appearance of a permanent wall.

The foregoing drawbacks were largely obviated by the free-standing, vertical wall, or space divider, invented by Messrs. Raymond P. Roberts and Sven Arthur John Nilsen, Jr., and disclosed in the co-pending U.S. Appln. Ser. No. 661,736, filed on Feb. 27, 1976 now U.S. Pat. No. 4,031,675. The present invention relates to improvements upon the concept disclosed in said Appln. Ser. No. 661,736, and particularly with respect to the wall panels and the components from which the wall panels are fabricated.

SUMMARY OF THE INVENTION

It is an object of the present invention to provide an improved wall panel frame which is adapted to form flush butt joints with an outer wall frame and with like adjoining panels.

Another object is to provide an improved wall panel frame having outwardly open side channels adapted to contain longitudinal splines movable laterally of said panel for connecting the panel to an adjoining outer frame member or for connecting adjoining panels.

A further object is to provide an improved wall panel frame having outwardly open side channels with resilient edges permitting insertion of a bladed tool at a butt joint to engage and move a spline within the channel laterally thereof.

Another object is to provide a wall panel channel frame construction having a longitudinal internal rib on its web for slidably mounting clip means to releasably position a spline at a position medially of the outer edge of the channel.

A still further object is to provide a wall panel channel frame construction having external edge grooves for mounting resilient strips and internal side grooves for receiving angular corner connecting plates.

Still another object is to provide a wall panel channel frame adapted to facilitate folding under and snubbing the marginal portions of sheet covering material on the faces of the panel.

These and other objects are accomplished by the improvements comprising the present invention, a preferred embodiment of which is shown in the attached drawings and hereinafter described in detail. Various modifications and changes in details of construction are comprehended within the scope of the appended claims.

DESCRIPTION OF A PREFERRED EMBODIMENT

Figure 1:
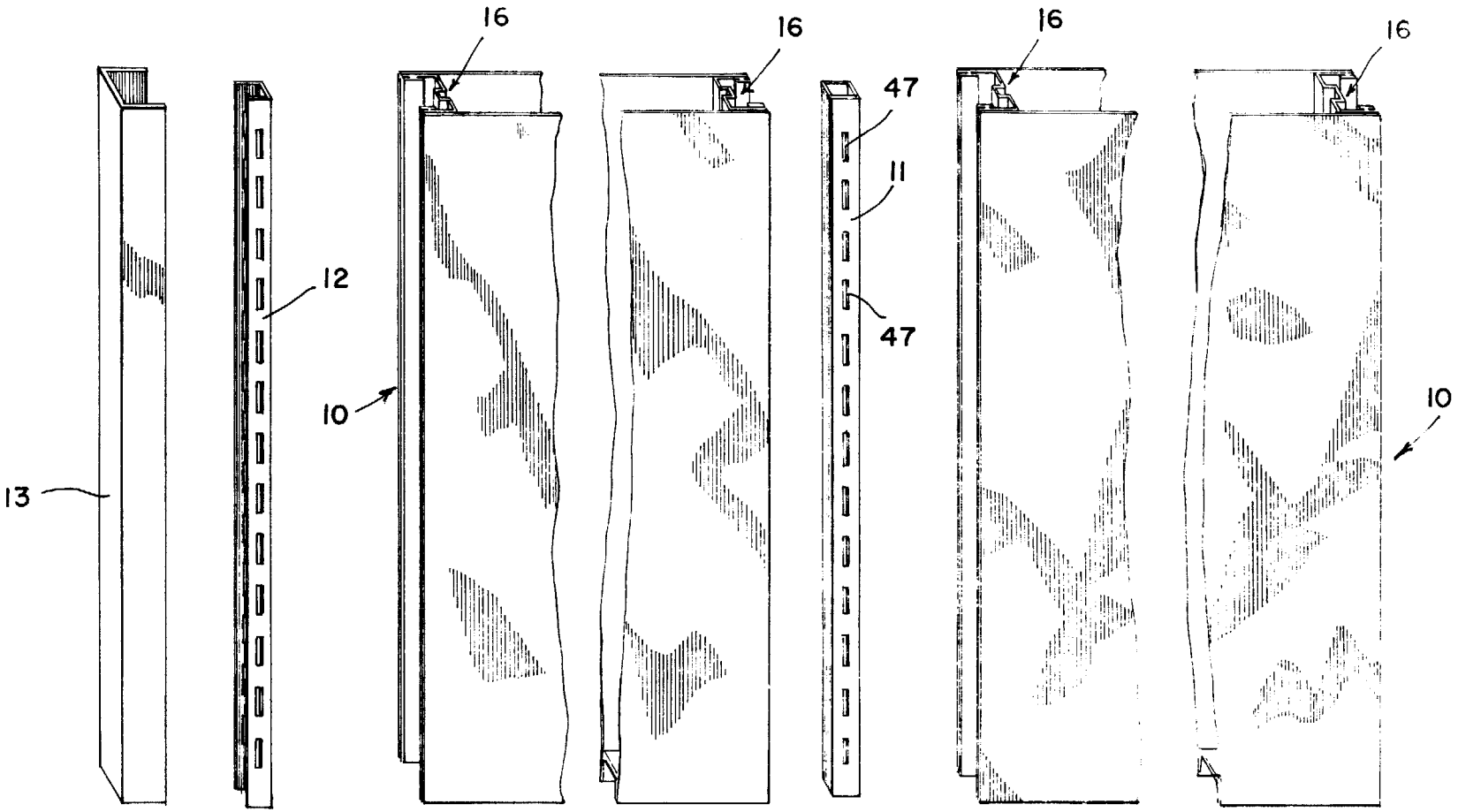
FIG. 1 is a schematic exploded perspective view of portions of a plurality of the improved wall panel units and splines in juxtaposition to an outer frame member for assembling a partition wall.

Referring first to FIG. 1, two adjoining rectangular panel modules are indicated generally at 10 with a tubular spline 11 between them, and a channel-shaped spline 12 between one of the panels and the side member 13 of an outer frame for supporting the panels when they are assembled into edge abutting relation with the splines between them. The ends of the splines may be mounted for lateral movement in top and bottom outer frame members (not shown). The details of a preferred outer frame construction and the manner of mounting the splines therein are described in my copending application Ser. No. 728,383 filed contemporaneously herewith.

Figure 3:
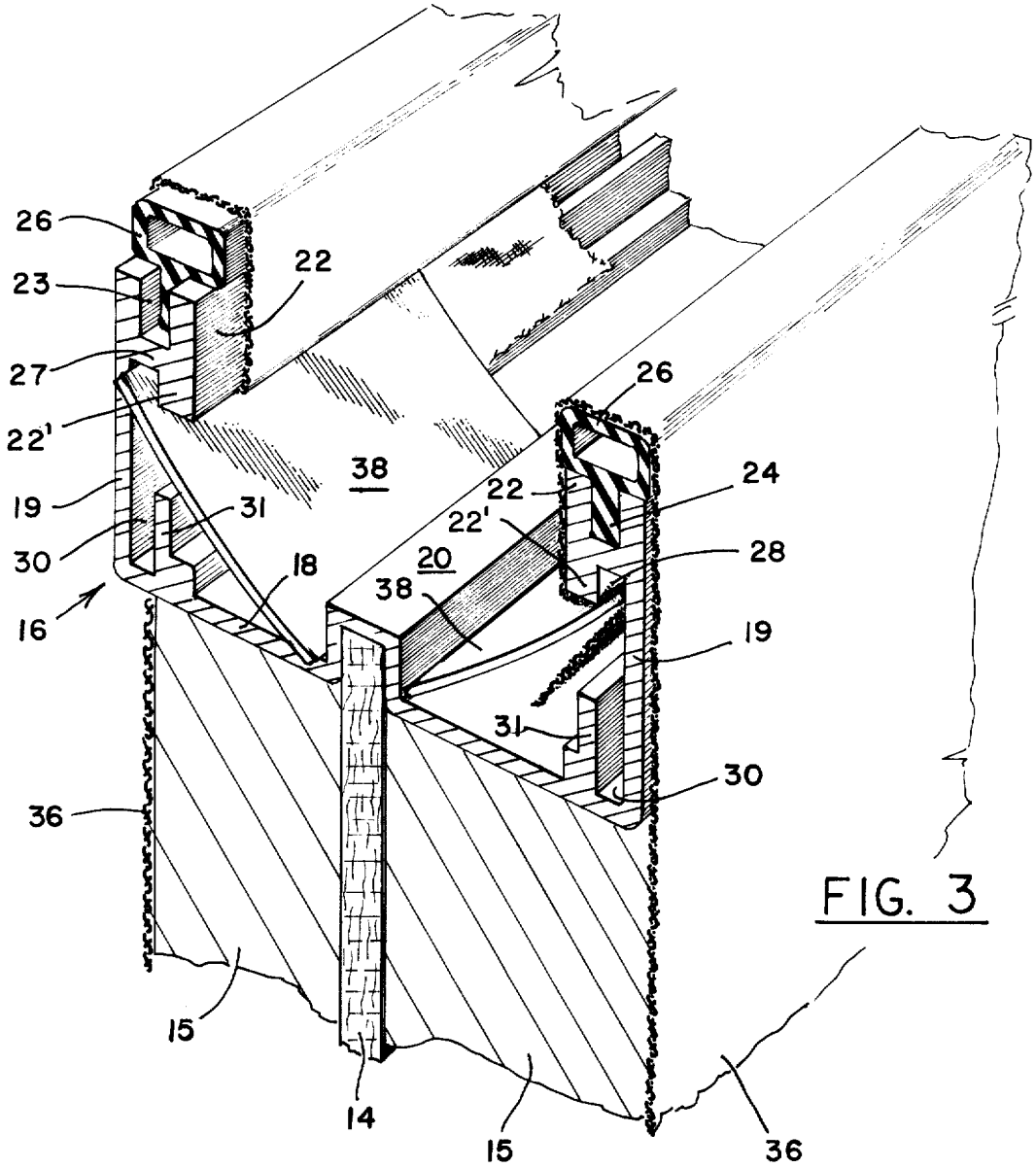
FIG. 3 is an enlarged perspective view, partly in section, showing the manner of folding under and snubbing panel covering material within a channel frame member of the panel.
Figure 4:
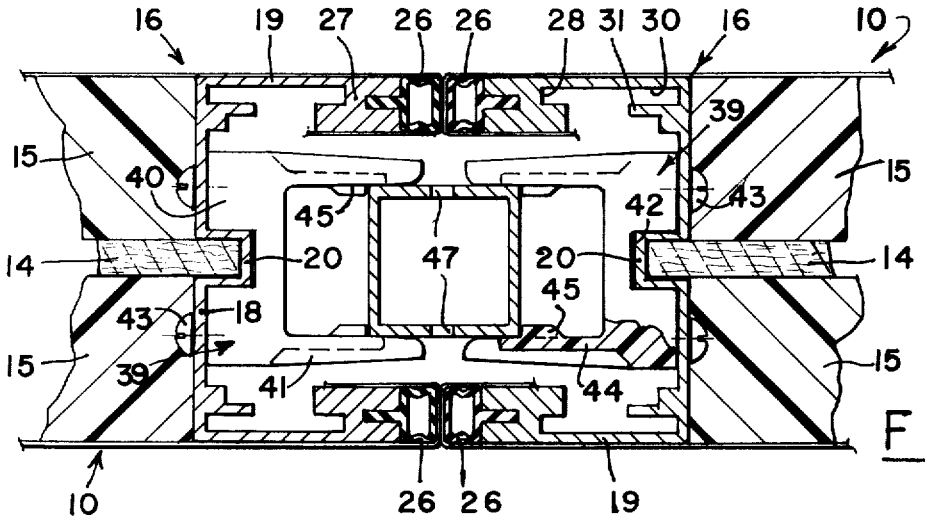
FIG. 4 is an enlarged cross-sectional view as on line 4—4 of FIG. 1, showing the joint between abutting panels with the spline positioned medially of the joint.
Figure 5:
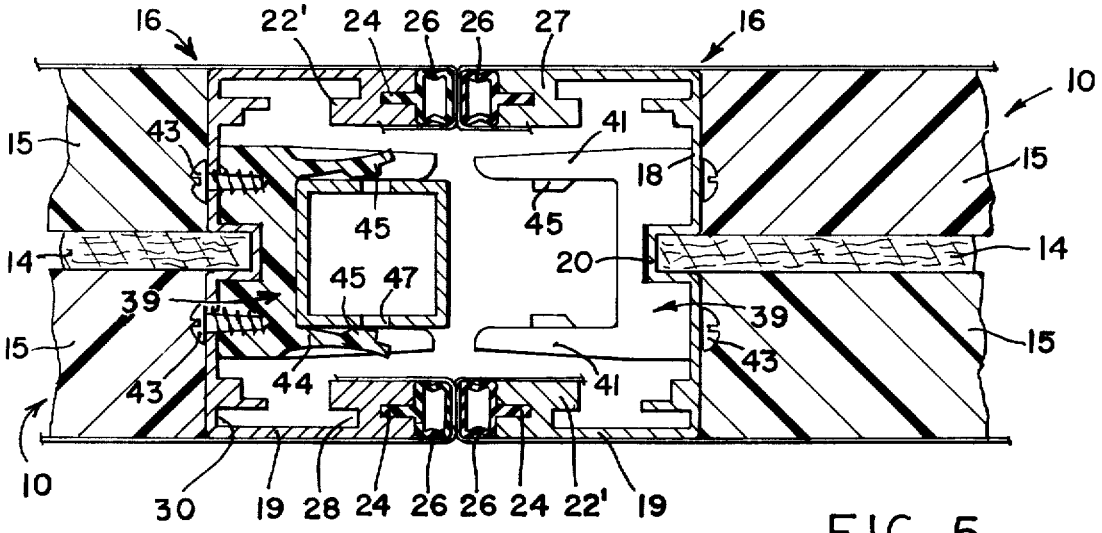
FIG. 5 is a similar view with the spline moved into one channel to clear the joint.

As shown in FIGS. 3 - 5, the panels may have a stiff central core ply 14 of fiberboard and the like, with laminations 15 of synthetic acoustical material on opposite surfaces. Preferably, the panels 10 are confined within a rectangular frame consisting of top, bottom and side channels indicated generally at 16 of extruded metal.

The channels 16 are open outwardly, that is, the webs 18 abut the edges of the laminations 14 and 15 and the legs 19 extend laterally outwardly therefrom. Preferably, each web 18 has an internal medial rib 20 extending longitudinally of the channel and forming an external groove for receiving a projecting edge of the core ply 14.

Spaced inside of the outer edge portions of the channel legs 19 and extending parallel therewith are longitudinal flanges 22 forming longitudinal outwardly facing grooves 23 adapted to receive the stems 24 of T-shaped resilient strips, preferably having hollow outer strips 26 abutting the outer edges of the legs. The strips 26 extend laterally beyond the interfacing edges of the channels 16 of adjoining panels 10, so as to form a resilient butt joint spacing apart the adjoining channels as shown in FIGS. 4 and 5. The bottom of each groove 23 is formed by a bridge wall 27 connecting the flange 22 to the channel leg 19, and the flange has an inner edge portion 22' projecting beyond the wall 27 to form an inner groove 28 under the wall 27 and facing oppositely from the outer groove 23.

Figure 2:
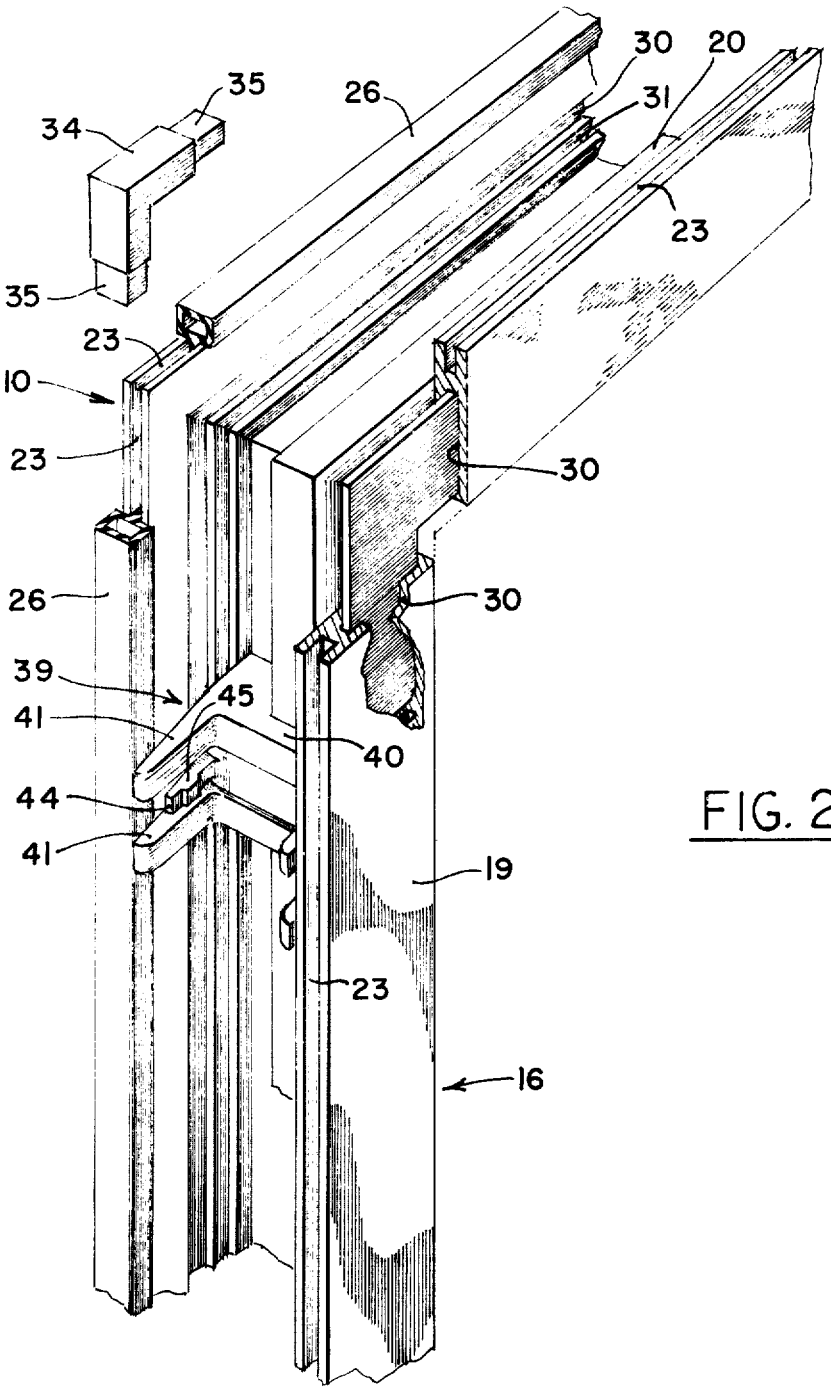
FIG. 2 is an enlarged fragmentary perspective view partly broken away, showing the corner construction of the panel frame, and one of the clip means for embracing and positioning a spline between panels.

At the inner corners of the channels 16 internal grooves 30 are formed between the legs 19 and parallel longitudinal flanges 31 spaced inwardly of the legs and preferably integral with the web 18. As shown in FIG. 3, the grooves 30 may be laterally aligned with the grooves 28 and 23. As shown in FIG. 2, the channels 16 are mitered at the corners of the panel, and angular or L-shaped connector plates 33 extend into the grooves 30 of intersecting channels for connecting them at the corners. L-shaped corner pieces 34, preferably of plastic material, are provided with reduced rectangular projections 35 for insertion into the hollow ends of intersecting resilient strips 26 to form right-angled corners therebetween.

The decorative sheet covering material for each panel is indicated at 36. This may be of a variety of materials including molded, extruded and woven synthetic sheeting. As best shown in FIG. 3, the marginal portions of the covering sheets for the sides of each panel are pulled tautly over the hollow resilient strips 26 abutting the outer edges of the channel legs 19, and then folded under into the channel alongside the flange 22. A plurality of flat snubbing pieces or plates indicated at 38 are provided to hold the marginal edge portions of the covering sheets tightly within the channels. The pieces 38 are thin and flexible and preferably of a suitable synthetic plastic material.

These snubbing plates 38 are designed to fit, in an inclined and slightly bowed position, with one edge in the inner groove 28 and the opposite edge in the corner at the base of the rib 20 on the side of the rib facing the groove. As clearly shown in FIG. 3, when the material 36 is folded in alongside and under the flange 22 and the edge of the snubbing plate 38 then inserted into the groove 28, the material 36 will be snubbed under and held taut by the projecting edge 22' of flange 22.

A number of the plates 38 are inserted at intervals along the channels to hold the covering material 36 over the faces of the panel, and the covering material thus confines the laminated panel tightly within the four channels 16 comprising the panel frame.

The means for positioning the splines 11 within the side channels of adjoining panels is shown in FIGS. 2, 4 and 5. Such means comprises channel-shaped clips of plastic material indicated generally at 39, each having a web 40 and legs 41. Preferably, two pairs of opposed clips 39 are used, one pair near the top of the panel joint and one near the bottom, although the number and spacing may be varied, as desired. The web 40 has a longitudinal groove 42 which fits over the rib 20 in the channel web 18 and screws 43 secure the web 40 to web 18. Thus, the rib 20 has three functions; it forms the groove which receives the outer edge of the core ply 14, it provides the base corner engaging the snubbing pieces 38, and it positions the clips 39 within the channels.

Preferably, the clips 39 have two pairs of spaced-apart, substantially rigid legs 41 with a pair of resilient fingers 44 between the legs. Stop lugs 45 on the inner surfaces of the fingers are adapted to abut opposite sides of the spline 11 when it is positioned medially of the butt joint between the strips 26 of adjoining panels, as shown in FIG. 4. In this position, the opposite sides of the spline are spaced from the webs 40 of the clips a distance equal to at least one-half the width of the spline, so that if the spline is moved laterally in either direction into abutment with one of the webs 40 as shown in FIG. 5, the opposite side of the spline will be clear of the butt joint, and either of the adjoining panels can be swung past the butt joint for assembly and removal.

To move the spline laterally in either direction a thin-bladed tool such as a screwdriver is used, and the blade is inserted through the butt joint between strips 26 and into engagement with the face of the spline. Preferably, the spline is provided with means to be engaged by the blade, and such means may be a longitudinal row of spaced slots 47 in the spline, as shown in FIG. 1, one pair of which is indicated in cross section in FIGS. 4 and 5. When the blade has engaged the spline, the exposed handle may be swung laterally, as permitted by the abutting resilient strips 26, to force the spline laterally past the lugs 45 by bending them outwardly as indicated in FIG. 5. During this movement of the spline, the legs 41 act to slidably guide the spline into abutment with the web 40, whereupon the adjoining panels can be swung apart at the butt joint.

It may be desirable to insert the blade at two or more locations along the spline to effect full lateral displacement of the spline. Also, the spline may be moved in two steps, first by engaging a slot 47 and then by engaging the corner of the spline.

A similar operation is performed to separate the end panel from the side member 13 of the outer frame, by moving the spline 12 laterally of the butt joint between the frame member 13 and the adjoining panel.

It will be apparent that a simple and improved wall panel construction has been provided which has flush resilient butt joints between panels containing laterally movable splines accessible to a blade passed through the joints for quickly and easily assembling and disassembling the panels. The improved construction utilizes novel extruded frame channels confining the panels and adapted to snub and anchor decorative panel covering material for confining the panels tightly within the frame by inserting simple snubbing pieces into the channels.

I claim:

1. A wall panel module having a rectangular frame comprising outwardly open side channels with laterally outwardly extending resilient outer edges adapted for abutting the resilient outer edges of like modules to form a vertical partition wall and the like having a resilient butt joint spacing apart the interfacing edges of adjoining panels, a vertical spline in at least one side channel having a width not exceeding the lateral depth of said channel and movable laterally therein to clear the outer edge of said channel, the web of said channel having a longitudinal internal rib, clip means mounted on said rib for releasably holding said spline in a position medial of said outer edge, and said spline being engageable by traversing a resilient edge of said channel for moving said spline laterally in said channel.

2. A wall panel module as defined in claim 1, wherein the channels have internal side grooves adapted to cooperate with said internal ribs to receive flexible plates for folding under and snubbing sheet material covering the faces of the panel.

3. A wall panel module as defined in claim 1, wherein the clip means is channel shaped with resilient fingers embracing said spline, and lugs on said fingers for holding said spline in medial position.

4. A wall panel module as defined in claim 3, wherein the clip means has substantially rigid guide legs adjacent to said resilient legs for guiding said spline laterally.

5. A wall panel module as defined in claim 1, wherein the channels have internal side grooves adapted to cooperate with said internal ribs to receive flexible plates for folding under and snubbing sheet material covering the faces of the panel, and the clip means is channel shaped with resilient fingers embracing said spline, and lugs on said fingers for holding said spline in medial position.

6. A vertical partition wall comprising modular wall panels each having outwardly open side channels with laterally outwardly extending resilient outer edges in abutment with the resilient outer edges of adjoining panels to form a resilient butt joint spacing apart the interfacing edges of adjoining channels, a vertical spline in each pair of adjoining side channels having a width not exceeding the depth of one channel and movable laterally therein, the webs of said channels having longitudinal internal ribs, clip means mounted on the rib of at least one of each pair of adjoining channels for releasably holding the spline in a position medially of the butt joint between the resilient outer edges of said channels, and said spline being engageable through the butt joint between the resilient outer edges of two adjoining channels for moving said spline laterally in said adjoining channels.

7. A vertical partition wall as defined in claim 6, wherein the side channels each have internal side grooves for receiving angular corner connecting plates.

8. A vertical partition wall as defined in claim 6, wherein the channels have internal side grooves adapted to cooperate with said internal ribs to receive flexible plates for folding under and snubbing sheet material covering the faces of the panels.

9. A vertical partition wall as defined in claim 6, wherein the clip means is channel shaped with resilient fingers embracing said spline, and lugs on said fingers for abutting said spline in medial position.

10. A vertical partition wall as defined in claim 9, wherein the clip means has substantially rigid guide legs adjacent to said resilient fingers for guiding said spline laterally.

11. A vertical partition wall as defined in claim 6, wherein the channels have internal side grooves adapted to cooperate with said internal ribs to receive flexible plates for folding under and snubbing sheet material covering the faces of the panel, and the clip means is channel shaped with resilient fingers embracing said spline, and lugs on said fingers for holding said spline in medial position.

* * * * *